US005758849A

United States Patent [19]

Bui et al.

[11] Patent Number: 5,758,849

[45] Date of Patent: Jun. 2, 1998

[54] ASSEMBLY FOR SUPPORTING A COMPUTER AND RELATED EQUIPMENT AT A SELECTED HEIGHT

[76] Inventors: Khan Duc Bui; Khoi Doc Bui, both of 11050 El Paraiso Ct., Fountain Valley, Calif. 92708

[21] Appl. No.: 769,757

[22] Filed: Dec. 20, 1996

[51] Int. Cl.[6] ..... A47B 21/02

[52] U.S. Cl. ..... 248/125.1; 248/125.2; 248/421; 248/917; 108/96; 108/145

[58] Field of Search ..... 108/145, 96; 248/917, 248/918, 125.1, 125.2, 421, 157, 177.1; 312/223.3, 312; 211/207

[56] References Cited

U.S. PATENT DOCUMENTS 1,893,551 1/1933 Kask ..... 312/312

4,026,222 5/1977 Mueller ..... 312/312 X 4,747,353 5/1988 Watt ..... 248/421 X 5,476,050 12/1995 Zimmer et al. ..... 108/145

*Primary Examiner*—Leslie A. Braun

*Assistant Examiner*—Donald J. Wallace

[57] ABSTRACT

An assembly for supporting a computer and related equipment at a selected height including at least one vertically oriented fixed stanchion. At least one support tray is slidably situated on the fixed stanchion along a vertical axis for supporting a monitor. Finally, an elevation control assembly is included for allowing a user to adjust the height of the monitor and CPU support tray and further maintain the height thereof.

7 Claims, 3 Drawing Sheets

ASSEMBLY FOR SUPPORTING A COMPUTER AND RELATED EQUIPMENT AT A SELECTED HEIGHT

BACKGROUND OF THE INVENTION

1. Field of the Invention

The present invention relates to an assembly for supporting a computer and related equipment at a selected height and more particularly pertains to supporting a monitor and other computer related equipment a various selected heights.

2. Description of the Prior Art

The use of computer stands is known in the prior art. More specifically, computer stands heretofore devised and utilized for the purpose of maintaining the monitor of a computer at a preselected height are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,836,486 to Vossoughi et al.; U.S. Pat. No. 4,589,621 to Hunt et al.; U.S. Pat. No. Des. 286,352 to Huculak; U.S. Pat. No. 5,357,873 to Hilton; U.S. Pat. No. 4,884,773 to Becker; and U.S. Pat. No. Des. 313,405 to Barry et al.

In this respect, the assembly for supporting a computer and related equipment at a selected height according to the present invention substantially departs from the conventional concepts and designs of the prior art, and in so doing provides an apparatus primarily developed for the purpose of supporting a monitor and other computer related equipment a various selected heights.

Therefore, it can be appreciated that there exists a continuing need for a new and improved assembly for supporting a computer and related equipment at a selected height which can be used for supporting a monitor and other computer related equipment a various selected heights, wherein the height of the monitor is conventionally adjusted. In this regard, the present invention substantially fulfills this need.

SUMMARY OF THE INVENTION

In view of the foregoing disadvantages inherent in the known types of computer stands now present in the prior art, the present invention provides an improved assembly for supporting a computer and related equipment at a selected height. As such, the general purpose of the present invention, which will be described subsequently in greater detail, is to provide a new and improved assembly for supporting a computer and related equipment at a selected height which has all the advantages of the prior art and none of the disadvantages.

To attain this, the present invention essentially comprises a planar base with a rectangular configuration. Further provided is a pair of vertically oriented fixed stanchions. Each stanchion is fixedly coupled to opposite sides of the planar base. A vertical slot is formed between a midpoint and a top thereof. It is imperative that the slots are aligned with each other. For supporting a conventional monitor and central processing unit(CPU), a monitor and CPU support unit is provided. The support unit includes a first lower CPU tray with a rectangular configuration for supporting a conventional CPU thereon. Situated directly above the lower CPU tray is a second upper monitor tray with a rectangular configuration. The upper monitor tray is adapted for supporting a conventional monitor thereon. Associated therewith is a pair of braces fixedly coupled between both sides of the trays. As such, the trays are maintained in the relative position thereof. A pair of posts are coupled to opposite sides of the upper monitor tray and reside along a common axis. The posts of the support unit are adapted to slidably engage a corresponding slot of the stanchions. By this structure, the monitor and CPU support unit may be slid between the midpoint and the top of the vertical stanchions. Also included is an elevation control assembly with a pair of lower arms. Each of the lower arms are pivotally coupled at first ends thereof to a bottom of a corresponding vertical stanchion. Ideally, the lower arms have a length approximately ½ the height of the stanchions. The elevation control assembly further includes a pair of upper arms each pivotally coupled at first ends thereof to second ends of the lower arms. Second ends of the upper arms are pivotally coupled to the posts of the monitor and CPU support unit between the vertical stanchions and the support unit. Similar to the lower arms, the upper arms have a length approximately ½ the height of the stanchions. The elevation control assembly further has a pair of pneumatic cylinders each coupled at first ends thereof to a corresponding lower arm. Such cylinders are further coupled at second ends thereof to a corresponding upper arm. In use, the pneumatic cylinder maintains the height of the monitor and CPU support tray. Further included is a keyboard tray with a planar rectangular configuration. The keyboard tray is coupled at opposite ends the first ends of the upper arms. As best shown in FIG. 2, a mouse tray is provided. The mouse tray has a rear extent with a planar rectangular configuration and a front extent having a semicircular cross-section. The mouse tray is coupled at a side edge thereof to an outer surface of one of the lower arms adjacent the second end thereof. For supporting a phone, a phone tray with a planar rectangular configuration is included. To maintain the phone on the tray, an upwardly extending lip is formed on a front edge thereof. The phone tray is fixedly coupled at a side edge thereof to an outer surface of one of the upper arms at the midpoint thereof. Preferably, as shown in FIG. 1, the phone tray remains at an angle. Finally, a pair of auxiliary trays are included each with a planar rectangular configuration. The auxiliary trays are each fixedly coupled at a side edge thereof to an outer surface of an associated vertical stanchion. Preferably, such coupling is situated adjacent the midpoint of the stanchions wherein the auxiliary trays remain in a horizontal orientation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved assembly for supporting a computer and related equipment at a selected height which has all the advantages of the prior art computer stands and none of the disadvantages.

It is another object of the present invention to provide a new and improved assembly for supporting a computer and related equipment at a selected height which may be easily and efficiently manufactured and marketed.

It is a further object of the present invention to provide a new and improved assembly for supporting a computer and related equipment at a selected height which is of a durable and reliable construction.

An even further object of the present invention is to provide a new and improved assembly for supporting a computer and related equipment at a selected height which is susceptible of a low cost of manufacture with regard to both materials and labor, and which accordingly is then susceptible of low prices of sale to the consuming public, thereby making such assembly for supporting a computer and related equipment at a selected height economically available to the buying public.

Still yet another object of the present invention is to provide a new and improved assembly for supporting a computer and related equipment at a selected height which provides in the apparatuses and methods of the prior art some of the advantages thereof, while simultaneously overcoming some of the disadvantages normally associated therewith.

Still another object of the present invention is to support a monitor and other computer related equipment a various selected heights.

Lastly, it is an object of the present invention to provide a new and improved assembly for supporting a computer and related equipment at a selected height including at least one vertically oriented fixed stanchion. At least one support tray is slidably situated on the fixed stanchion along a vertical axis for supporting a monitor. Finally, an elevation control assembly is included for allowing a user to adjust the height of the monitor and CPU support tray and further maintain the height thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
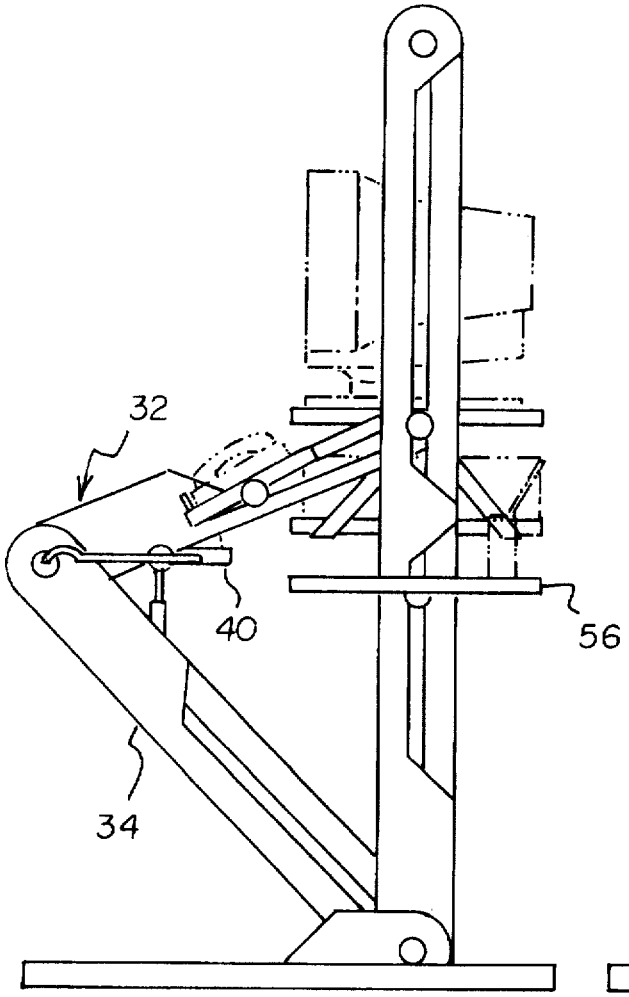
FIG. 1 is an illustration of the preferred embodiment of the assembly for supporting a computer and related equipment at a selected height constructed in accordance with the principles of the present invention.

With reference now to the drawings, and in particular to FIG. 1 thereof, a new and improved assembly for supporting a computer and related equipment at a selected height embodying the principles and concepts of the present invention and generally designated by the reference numeral 10 will be described.

The present invention, the new and improved assembly for supporting a computer and related equipment at a selected height, is comprised of a plurality of components. Such components in their broadest context include a pair of stanchions, a CPU and monitor support unit, an elevation control assembly, a keyboard tray, a mouse tray, a phone tray, and a plurality of auxiliary trays. Such components are individually configured and correlated with respect to each other so as to attain the desired objective.

More specifically, it will be noted that the system 10 of the present invention includes a planar base 12 with a rectangular configuration.

Further provided is a pair of vertically oriented fixed stanchions 14. Each stanchion is fixedly coupled to opposite sides of the planar base. Preferably, such coupling is afforded approximately ¼ the length of the base from a rear edge thereof. A closed vertical slot 16 is formed between a midpoint and a top of each stanchion. It is imperative that the slots are aligned with each other.

For supporting a conventional monitor 18 and central processing unit(CPU) 20, a monitor and CPU support unit 22 is provided. The support unit includes a first lower CPU tray 24 with a rectangular configuration for supporting a conventional CPU thereon. Situated directly above the lower CPU tray is a second upper monitor tray 26 with a rectangular configuration. The upper monitor tray is adapted for supporting a conventional monitor thereon. Associated therewith is a pair of braces 28 fixedly coupled between both sides of the trays. Such braces ideally form a triangular configuration for affording optimum stability. As such, the trays are maintained in the relative position thereof. A pair of posts 30 are coupled to opposite sides of the upper monitor tray at an upper apex of each pair of braces and further reside along a common axis. The posts of the support unit are adapted to slidably engage a corresponding slot of the stanchions. Preferably, to ensure that both of the both trays are maintained in a respective horizontal plane, the outer ends of each of the posts has a square cross-section. By this structure, the monitor and CPU support unit may be slid between the midpoint and the top of the vertical stanchions without tipping or the like.

Also included is an elevation control assembly 32 with a pair of lower arms 34. Each of the lower arms are pivotally coupled at first ends thereof to a bottom of a corresponding vertical stanchion. Ideally, the lower arms have a length approximately ½ the height of the stanchions. The elevation control assembly further includes a pair of upper arms 36 each pivotally coupled at first ends thereof to second ends of the lower arms. Second ends of the upper arms are pivotally coupled to the posts of the monitor and CPU support unit between the vertical stanchions and the support unit. The cross-sections of the posts whereat the upper arms are coupled ideally comprise a circular cross-section. Similar to the lower arms, the upper arms have a length approximately ½ the height of the stanchions. The elevation control assembly further has a pair of pneumatic cylinders 38 each coupled at first ends thereof to an approximate midpoint of a corresponding lower arm. Such cylinders are further coupled at second ends thereof to an approximate midpoint of a corresponding upper arm. In use, the pneumatic cylinder allows a user to selectively elevate and lower the monitor and CPU support tray and further maintain the height thereof.

Further included is a keyboard tray 40 with a planar rectangular configuration. The keyboard tray is coupled at opposite ends thereof between the first ends of the upper arms. Ideally, the keyboard tray is pivotally coupled for allowing the keyboard to be maintained in a horizontal orientation during movement of the arms. Due to this structure, it is mandatory that the keyboard be balanced on the keyboard tray. Optionally, the keyboard tray may be frictionally engaged with the upper arms in addition to the pivotal coupling to prevent any tipping when the keyboard is used. In such embodiment, the keyboard tray would have to be manually oriented in a horizontal plane upon movement of the elevational control assembly.

Figure 2:
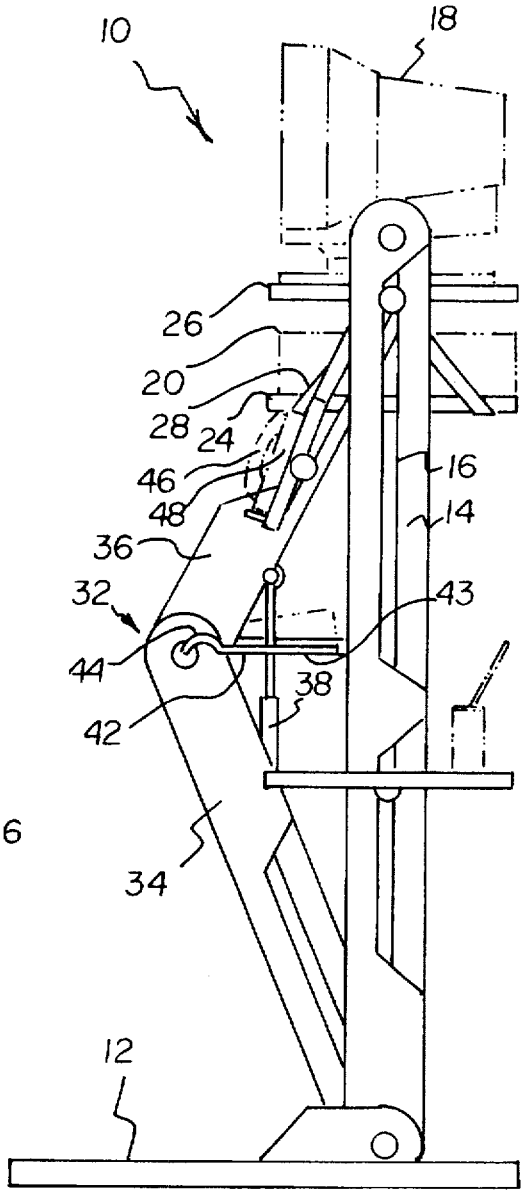
FIG. 2 is a side view of the present invention with the CPU and monitor support tray in an elevated orientation.
Figure 3:
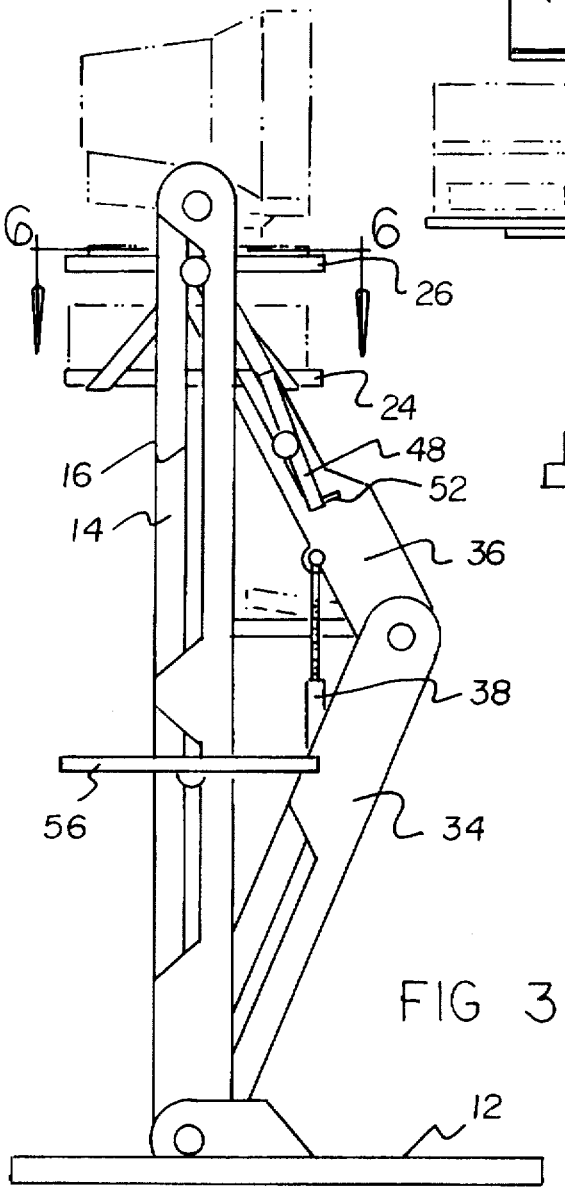
FIG. 3 is another side view of the present invention with the CPU and monitor support tray in an elevated orientation.
Figure 4:
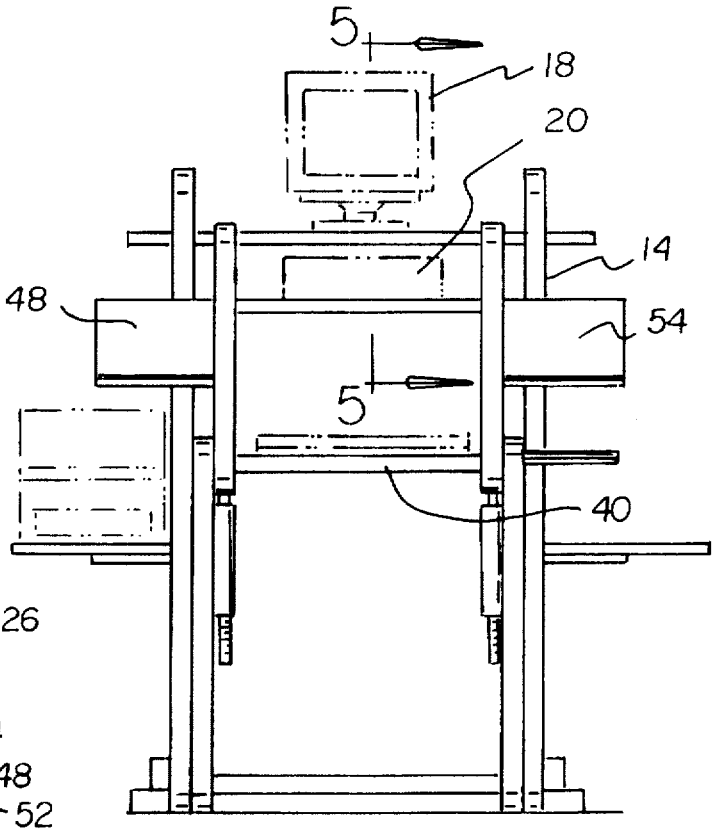
FIG. 4 is a front elevational view of the present invention.
Figure 5:
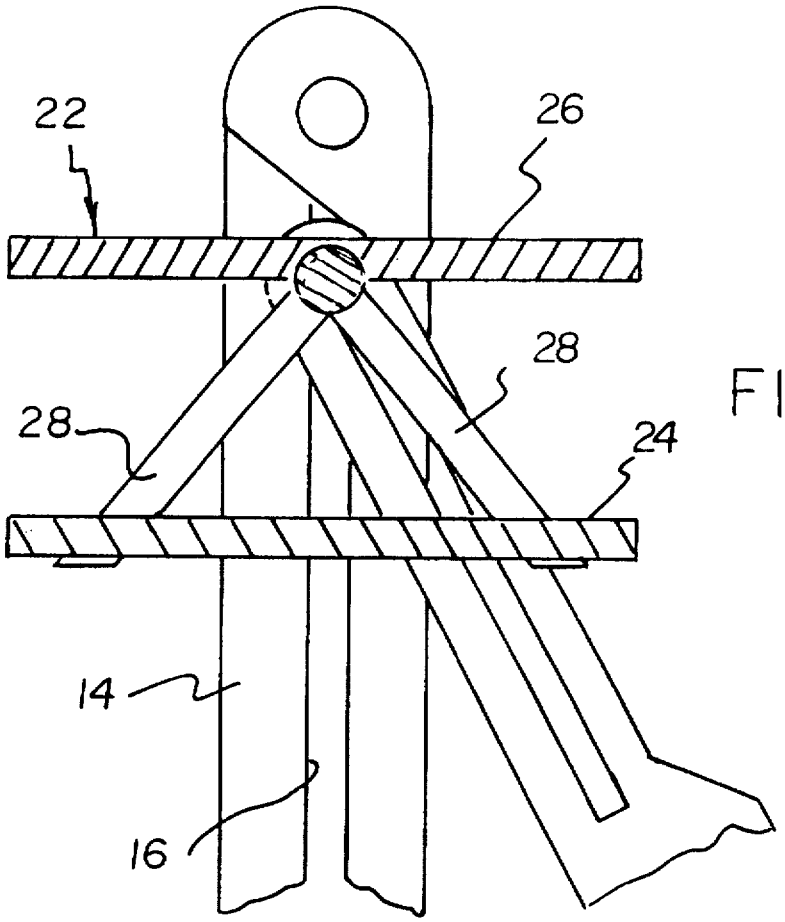
FIG. 5 is a cross-sectional view of the present invention taken along line 5—5 shown in FIG. 4.
Figure 6:
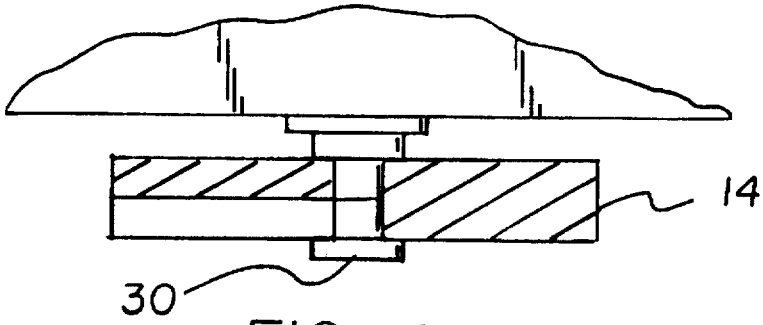
FIG. 6 is a cross-sectional view of the present invention taken along line 6—6 shown in FIG. 3.

As best shown in FIG. 2, a mouse tray 42 is provided. The mouse tray has a rear extent 43 with a planar rectangular configuration and a front extent 44 having a semicircular cross-section. The mouse tray is coupled at a side edge thereof to an outer surface of one of the lower arms adjacent the second end thereof. Similar to the keyboard tray, the mouse tray is pivotally coupled for allowing the mouse to maintain a horizontal orientation during movement of the arms. optionally, the mouse tray may also be frictionally engaged with the lower arm in addition to the pivotally coupling to prevent any tipping when the mouse is utilized.

For supporting a phone 46, a phone tray 48 with a planar rectangular configuration is included. To maintain the phone on the tray, an upwardly extending lip 52 is formed on a front edge thereof. The phone tray is fixedly coupled at a side edge thereof to an outer surface of one of the upper arms at the midpoint thereof. Preferably, as shown in FIG. 1, the phone tray remains at an angle which varies upon movement of the arms.

Positioned symmetrically with the phone tray is an additional tray 54 with a lip for use with another phone, note pad, or the like. The phone tray and tray 54 are fixedly coupled to the upper arms with the lip precluding objects supported thereon from falling as a result of movement of the upper arms.

Finally, a pair of auxiliary trays 56 are included each with a planar rectangular configuration. The auxiliary trays are each fixedly coupled at a side edge thereof to an outer surface of an associated vertical stanchion. Preferably, such coupling is situated adjacent the midpoint of the stanchions wherein the auxiliary trays remain in a horizontal orientation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved assembly for supporting a computer and related equipment at a selected height comprising, in combination:

a planar base with a rectangular configuration;

a pair of vertically oriented fixed stanchions each fixedly coupled to opposite sides of the planar base, each stanchion having a vertical slot formed between a midpoint and a top thereof, wherein the slots are aligned with each other;

a monitor and CPU support unit including a first lower CPU tray with a rectangular configuration for supporting a conventional CPU thereon, a second upper monitor tray situated directly above the lower CPU tray with a rectangular configuration for supporting a conventional monitor thereon, a pair of braces fixedly coupled between both sides of the trays for maintaining the relative position thereof, a pair of posts coupled to opposite sides of the upper monitor tray and residing along a common axis, the posts of the support unit adapted to slidably engage a corresponding slot of the stanchions for allowing the monitor and CPU support unit to be slid between the midpoint and the top of the vertical stanchions;

an elevation control assembly including a pair of lower arms each pivotally coupled at first ends thereof to a bottom of a corresponding vertical stanchion, the lower arms having a length approximately ½ the height of the stanchions, the elevation control assembly further including a pair of upper arms each pivotally coupled at first ends thereof to second ends of the lower arms and pivotally coupled at second ends thereof to the posts of the monitor and CPU support unit between the vertical stanchions and the support unit, the upper arms having a length approximately ½ the height of the stanchions, the elevation control assembly further having a pair of pneumatic cylinders each coupled at first ends thereof to a midpoint of a corresponding lower arm and further coupled at second ends thereof to a midpoint of a corresponding upper arm, whereby the pneumatic cylinder maintains the height of the monitor and CPU support tray;

a keyboard tray with a planar rectangular configuration, the keyboard tray coupled at opposite ends thereof between the upper arms adjacent the first ends thereof;

a mouse tray with a rear extent having a planar rectangular configuration and a front extent having a semicircular cross-section, the mouse tray coupled at a side edge thereof to an outer surface of one of the lower arms adjacent the second end thereof;

a phone tray with a planar rectangular configuration and an upwardly extending lip formed on a front edge thereof, the phone tray fixedly coupled at a side edge thereof to an outer surface of one of the upper arms at the midpoint thereof such that the phone tray remains at an angle with respect to the horizontal; and a pair of auxiliary trays each with a planar rectangular configuration, the auxiliary trays each fixedly coupled at a side edge thereof to an outer surface of an associated vertical stanchion adjacent the midpoint thereof such that the auxiliary trays remain in a horizontal orientation.

2. An assembly for supporting a computer and related equipment at a selected height comprising:

a pair of vertically oriented fixed stanchions;

at least one support tray slidably situated on the fixed stanchion along a vertical axis for supporting a monitor; and an elevation control assembly for allowing a user to adjust the height of the tray and further maintain the height thereof;

wherein the elevation control assembly includes a pair of lower arms each pivotally coupled at first ends thereof to a bottom of a corresponding vertical stanchion, the elevation control assembly further including a pair of upper arms each pivotally coupled at first ends thereof to second ends of the lower arms and pivotally coupled at second ends thereof to posts of the monitor and CPU support unit between the vertical stanchions and the support unit, the elevation control assembly further having a pair of pneumatic cylinders each coupled at first ends thereof to a midpoint of a corresponding lower arm and further coupled at second ends thereof to a midpoint of a corresponding upper arm, whereby the pneumatic cylinder maintains the height of the monitor and CPU support tray.

3. An assembly for supporting a computer and related equipment at a selected height as set forth in claim 2 wherein the at least one support tray includes a monitor and CPU support unit including a first lower CPU tray with a rectangular configuration for supporting a conventional CPU thereon, a second upper monitor tray situated directly above the lower CPU tray with a rectangular configuration for supporting a conventional monitor thereon, a pair of braces fixedly coupled between both sides of the trays for maintaining the relative position thereof, a pair of posts coupled to opposite sides of the upper monitor tray and residing along a common axis, the posts of the support unit adapted to slidably engage a corresponding slot of the stanchions for allowing the monitor and CPU support unit to be slid between a midpoint and a top of the vertical stanchions.

4. An assembly for supporting a computer and related equipment at a selected height as set forth in claim 2 and further including a keyboard tray with a planar rectangular configuration, the keyboard tray coupled at opposite ends thereof between the upper arms adjacent the first ends thereof.

5. An assembly for supporting a computer and related equipment at a selected height as set forth in claim 2 and further including a mouse tray with a rear extent having a planar rectangular configuration and a front extent having a semicircular cross-section, the mouse tray coupled at a side edge thereof to an outer surface of one of the lower arms adjacent the second end thereof.

6. An assembly for supporting a computer and related equipment at a selected height as set forth in claim 2 and further including a phone tray with a planar rectangular configuration and an upwardly extending lip formed on a front edge thereof, the phone tray fixedly coupled at a side edge thereof to an outer surface of one of the upper arms at the midpoint thereof such that the phone tray remains at an angle.

7. An assembly for supporting a computer and related equipment at a selected height as set forth in claim 2 and further including a pair of auxiliary trays each with a planar rectangular configuration, the auxiliary trays each fixedly coupled at a side edge thereof to an outer surface of an associated vertical stanchion adjacent the midpoint thereof such that the auxiliary trays remain in a horizontal orientation.

* * * * *